US006805965B2

(12) United States Patent
Liu

(10) Patent No.: US 6,805,965 B2
(45) Date of Patent: Oct. 19, 2004

(54) METHOD FOR THE APPLICATION OF HYDROPHOBIC CHEMICALS TO TISSUE WEBS

(75) Inventor: Kou-Chang Liu, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/036,735

(22) Filed: Dec. 21, 2001

(65) Prior Publication Data

US 2003/0118848 A1 Jun. 26, 2003

(51) Int. Cl.[7] ..... B32B 15/04

(52) U.S. Cl. ..... 428/452; 264/555; 264/518; 264/211; 427/180; 427/200; 427/199; 427/288; 428/477; 162/135; 162/265; 162/109; 424/401; 424/400; 424/443

(58) Field of Search ..... 264/555, 518, 264/211; 427/180, 200, 199, 288; 428/447, 452; 162/135, 265, 109; 424/401, 400, 443

(56) References Cited

U.S. PATENT DOCUMENTS

| | | | |
|---|---|---|---|
| 2,345,543 | A | 3/1944 | Wohnsiedler et al. |
| 2,926,116 | A | 2/1960 | Keim |
| 2,926,154 | A | 2/1960 | Keim |
| 3,556,932 | A | 1/1971 | Coscia et al. |
| 3,556,933 | A | 1/1971 | Stamford et al. |
| 3,700,623 | A | 10/1972 | Keim |
| 3,722,469 | A | 3/1973 | Bartley et al. |
| 3,772,076 | A | 11/1973 | Keim |
| 3,849,241 | A | 11/1974 | Butin et al. |
| 3,865,078 | A | 2/1975 | De Howitt et al. |
| 3,885,158 | A | 5/1975 | Flutie et al. |
| 3,899,388 | A | 8/1975 | Petrovich et al. |
| 3,905,329 | A | 9/1975 | Cone et al. |
| 3,930,465 | A | 1/1976 | Schuierer |
| 4,005,028 | A | 1/1977 | Heckert |
| 4,005,030 | A | 1/1977 | Heckert |
| 4,016,831 | A | 4/1977 | James et al. |
| 4,023,526 | A | 5/1977 | Ashmus et al. |
| 4,061,001 | A | 12/1977 | Von Der Eltz et al. |
| 4,081,318 | A | 3/1978 | Wietsma |
| 4,089,296 | A | 5/1978 | Barchi |
| 4,099,913 | A | 7/1978 | Walter et al. |
| 4,118,526 | A | 10/1978 | Gregorian et al. |
| 4,129,528 | A | 12/1978 | Petrovich et al. |
| 4,147,586 | A | 4/1979 | Petrovich et al. |
| 4,158,076 | A | 6/1979 | Wallsten |
| 4,159,355 | A | 6/1979 | Kaufman |
| 4,184,914 | A | 1/1980 | Jenkins |
| 4,193,762 | A | 3/1980 | Namboodri |
| 4,198,316 | A | 4/1980 | Nahta |
| 4,222,921 | A | 9/1980 | Van Eenam |

(List continued on next page.)

FOREIGN PATENT DOCUMENTS

| | | |
|---|---|---|
| DE | 252208 | 10/1912 |
| EP | 0047908 A1 | 3/1982 |
| EP | 0098362 B1 | 1/1984 |

(List continued on next page.)

OTHER PUBLICATIONS

Article—*Recent Developments in Foam Applications Systems*, Gaston County Environmental Systems, 4 pages.

*Primary Examiner*—Kuo-Liang Peng
(74) *Attorney, Agent, or Firm*—Dority & Manning, P.A.

(57) ABSTRACT

A method is disclosed for topical application of compositions containing a chemical additive onto a paper web. The present invention is also directed to paper products formed from the method. In general, the method includes the steps of extruding a composition containing a chemical additive through a melt blown die and then applying the composition to a moving paper web. In one embodiment, the chemical composition is extruded into fibers and applied to the paper web. The chemical composition can contain, for instance, various additives, such as a polysiloxane softener.

53 Claims, 4 Drawing Sheets

U.S. PATENT DOCUMENTS

| | | | |
|---|---|---|---|
| 4,230,746 | A | 10/1980 | Nahta |
| 4,237,818 | A | 12/1980 | Clifford et al. |
| 4,263,344 | A | 4/1981 | Radvan et al. |
| 4,276,339 | A | 6/1981 | Stoveken |
| 4,279,964 | A | 7/1981 | Heller |
| 4,288,475 | A | 9/1981 | Meeker |
| 4,297,860 | A | 11/1981 | Pacifici et al. |
| 4,305,169 | A | 12/1981 | Vidalis |
| 4,343,835 | A | 8/1982 | Jones et al. |
| 4,348,251 | A | 9/1982 | Pauls et al. |
| 4,364,784 | A | 12/1982 | Van Wersch et al. |
| 4,366,682 | A | 1/1983 | Keller |
| 4,384,867 | A | 5/1983 | Grüber |
| 4,385,954 | A | 5/1983 | Pauls et al. |
| 4,387,118 | A | 6/1983 | Shelton |
| 4,400,953 | A | 8/1983 | Driessen et al. |
| 4,402,200 | A | 9/1983 | Clifford et al. |
| 4,435,965 | A | 3/1984 | Sasseville et al. |
| 4,440,808 | A | 4/1984 | Mitter |
| 4,442,771 | A | 4/1984 | Mitter |
| 4,444,104 | A | 4/1984 | Mitter |
| 4,453,462 | A | 6/1984 | Mitter |
| 4,463,467 | A | 8/1984 | Grüber et al. |
| 4,463,583 | A | 8/1984 | Krüger et al. |
| 4,474,110 | A | 10/1984 | Rosner |
| 4,497,273 | A | 2/1985 | Mitter |
| 4,498,318 | A | 2/1985 | Mitter |
| 4,501,038 | A | 2/1985 | Otting |
| 4,502,304 | A | 3/1985 | Hopkins |
| 4,534,189 | A | 8/1985 | Clifford |
| 4,552,778 | A | 11/1985 | Zimmer |
| 4,557,218 | A | 12/1985 | Sievers |
| 4,559,243 | A | 12/1985 | Pässler et al. |
| 4,562,097 | A | 12/1985 | Walter et al. |
| 4,571,360 | A | 2/1986 | Brown et al. |
| 4,576,112 | A | 3/1986 | Funger et al. |
| 4,581,254 | A | 4/1986 | Cunningham et al. |
| 4,597,831 | A | 7/1986 | Anderson |
| 4,603,176 | A | 7/1986 | Bjorkquist et al. |
| 4,605,702 | A | 8/1986 | Guerro et al. |
| 4,612,874 | A | 9/1986 | Mitter |
| 4,618,689 | A | 10/1986 | Traver et al. |
| 4,646,675 | A | 3/1987 | Arthur et al. |
| 4,655,056 | A | 4/1987 | Zeiffer |
| 4,665,723 | A | 5/1987 | Zimmer |
| 4,667,882 | A | 5/1987 | Pacifici |
| 4,699,988 | A | 10/1987 | Traver et al. |
| 4,731,092 | A | 3/1988 | Berendt |
| 4,734,100 | A | 3/1988 | Berendt et al. |
| 4,741,739 | A | 5/1988 | Berendt et al. |
| 4,762,727 | A | 8/1988 | Voswinckel |
| 4,773,110 | A | 9/1988 | Hopkins |
| 4,778,477 | A | 10/1988 | Lauchenauer |
| 4,792,619 | A | 12/1988 | Berendt et al. |
| 4,799,278 | A | 1/1989 | Beeh |
| 4,833,748 | A | 5/1989 | Zimmer et al. |
| 4,872,325 | A | 10/1989 | Moser et al. |
| 4,894,118 | A | 1/1990 | Edwards et al. |
| 4,911,956 | A | 3/1990 | Gabryszewski et al. |
| 4,912,948 | A | 4/1990 | Brown et al. |
| 4,943,350 | A | 7/1990 | Bogart et al. |
| 4,950,545 | A | 8/1990 | Walter et al. |
| 5,008,131 | A | 4/1991 | Bakhshi |
| 5,009,932 | A | 4/1991 | Klett et al. |
| 5,048,589 | A | 9/1991 | Cook et al. |
| 5,059,282 | A | 10/1991 | Ampulski et al. |
| 5,089,296 | A | 2/1992 | Bafford et al. |
| 5,098,979 | A | 3/1992 | O'Lenick, Jr. |
| 5,145,527 | A | 9/1992 | Clifford et al. |
| 5,164,046 | A | 11/1992 | Ampulski et al. |
| 5,165,261 | A | 11/1992 | Cho |
| 5,215,626 | A | 6/1993 | Ampulski et al. |
| 5,219,620 | A | 6/1993 | Potter et al. |
| 5,227,023 | A | 7/1993 | Pounder et al. |
| 5,227,242 | A | 7/1993 | Walter et al. |
| 5,237,035 | A | 8/1993 | O'Lenick, Jr. et al. |
| 5,245,545 | A | 9/1993 | Taylor |
| 5,246,545 | A | 9/1993 | Ampulski et al. |
| 5,246,546 | A | 9/1993 | Ampulski |
| 5,328,685 | A | 7/1994 | Janchiraponvej et al. |
| 5,340,609 | A | 8/1994 | Arthur et al. |
| 5,366,161 | A | 11/1994 | Potter et al. |
| 5,385,643 | A | 1/1995 | Ampulski |
| 5,389,204 | A | 2/1995 | Ampulski |
| 5,399,412 | A | 3/1995 | Sudall et al. |
| 5,466,337 | A | 11/1995 | Darlington et al. |
| 5,492,655 | A | 2/1996 | Morton et al. |
| 5,505,997 | A | 4/1996 | Strong et al. |
| 5,510,001 | A | 4/1996 | Hermans et al. |
| 5,525,345 | A | 6/1996 | Warner et al. |
| 5,538,595 | A | 7/1996 | Trokhan et al. |
| 5,552,020 | A | 9/1996 | Smith et al. |
| 5,573,637 | A | 11/1996 | Ampulski et al. |
| 5,591,309 | A | 1/1997 | Rugowski et al. |
| 5,601,871 | A | 2/1997 | Krzysik et al. |
| 5,605,719 | A | 2/1997 | Tench et al. |
| 5,614,293 | A | 3/1997 | Krzysik et al. |
| 5,623,043 | A | 4/1997 | Fost et al. |
| 5,624,676 | A | 4/1997 | Mackey et al. |
| 5,635,469 | A | 6/1997 | Fowler et al. |
| 5,650,218 | A | 7/1997 | Krzysik et al. |
| 5,665,426 | A | 9/1997 | Krzysik et al. |
| 5,667,636 | A | 9/1997 | Engel et al. |
| 5,688,496 | A | 11/1997 | Fost et al. |
| 5,705,164 | A | 1/1998 | Mackey et al. |
| 5,707,434 | A | 1/1998 | Halloran et al. |
| 5,707,435 | A | 1/1998 | Halloran |
| 5,725,736 | A | 3/1998 | Schroeder et al. |
| 5,792,737 | A | 8/1998 | Grüning et al. |
| 5,807,956 | A | 9/1998 | Czech |
| 5,814,188 | A | 9/1998 | Vinson et al. |
| 5,830,483 | A | 11/1998 | Seidel et al. |
| 5,840,403 | A | 11/1998 | Trokhan et al. |
| 5,849,313 | A | 12/1998 | Fost et al. |
| 5,856,544 | A | 1/1999 | Czech et al. |
| 5,857,627 | A | 1/1999 | Horwell et al. |
| 5,861,143 | A | 1/1999 | Peterson et al. |
| 5,869,075 | A | 2/1999 | Krzysik |
| 5,871,763 | A | 2/1999 | Luu et al. |
| 5,882,573 | A | 3/1999 | Kwok et al. |
| 5,885,697 | A | 3/1999 | Krzysik et al. |
| 5,902,540 | A | 5/1999 | Kwok |
| 5,904,298 | A | 5/1999 | Kwok et al. |
| 5,904,809 | A | 5/1999 | Rokman et al. |
| 5,925,469 | A | 7/1999 | Gee |
| 5,935,383 | A | 8/1999 | Sun et al. |
| 5,981,681 | A | 11/1999 | Czech |
| 5,985,434 | A | 11/1999 | Qin et al. |
| 5,990,377 | A | 11/1999 | Chen et al. |
| 6,017,417 | A | 1/2000 | Wendt et al. |
| 6,030,675 | A | 2/2000 | Schroeder et al. |
| 6,033,723 | A | 3/2000 | Kistler et al. |
| 6,054,020 | A | 4/2000 | Goulet et al. |
| 6,077,375 | A | 6/2000 | Kwok |
| 6,090,885 | A | 7/2000 | Kuo et al. |
| 6,103,128 | A | 8/2000 | Koso et al. |
| 6,120,784 | A | 9/2000 | Snyder, Jr. |
| 6,126,784 | A | 10/2000 | Ficke et al. |
| 6,132,803 | A | 10/2000 | Kelly et al. |
| 6,183,814 | B1 | 2/2001 | Nangeroni et al. |
| 6,217,707 | B1 | 4/2001 | Garvey et al. |

| | | | |
|---|---|---|---|
| 6,217,940 | B1 | 4/2001 | Kuni |
| 6,231,719 | B1 | 5/2001 | Garvey et al. |
| 6,238,518 | B1 | 5/2001 | Rokman et al. |
| 6,238,682 | B1 | 5/2001 | Klofta et al. |
| 6,306,408 | B1 | 10/2001 | Eichhorn et al. |
| 6,322,604 | B1 | 11/2001 | Midkiff |
| 6,432,268 | B1 | 8/2002 | Burghardt |
| 6,432,270 | B1 | 8/2002 | Liu et al. |
| 6,547,928 | B2 | 4/2003 | Barnholtz et al. |
| 6,607,783 | B1 | 8/2003 | VanderHeiden et al. |
| 2002/0112835 | A1 | 8/2002 | Liu et al. |
| 2003/0118847 | A1 | 6/2003 | Chuang et al. |
| 2003/0118848 | A1 | 6/2003 | Liu |

FOREIGN PATENT DOCUMENTS

| | | | |
|---|---|---|---|
| EP | 0120472 | A1 | 10/1984 |
| EP | 0195458 | A1 | 9/1986 |
| EP | 0196576 | B1 | 10/1986 |
| EP | 0333212 | A2 | 9/1989 |
| EP | 0336439 | A2 | 10/1989 |
| EP | 1023863 | A1 | 2/2000 |
| EP | 1059032 | A1 | 12/2000 |
| EP | 1149947 | A2 | 10/2001 |
| EP | 1236827 | A1 | 9/2002 |
| WO | WO 9704171 | | 2/1997 |
| WO | WO 9840207 | A1 | 9/1998 |
| WO | WO 9913158 | A1 | 3/1999 |
| WO | WO 9919081 | | 4/1999 |
| WO | WO 0015907 | A1 | 3/2000 |
| WO | WO 0068503 | A1 | 11/2000 |
| WO | WO 0071177 | A1 | 11/2000 |
| WO | WO 0128337 | | 4/2001 |
| WO | WO 0129315 | | 4/2001 |
| WO | WO 0216689 | A2 | 2/2002 |
| WO | WO 0248458 | A1 | 6/2002 |

METHOD FOR THE APPLICATION OF HYDROPHOBIC CHEMICALS TO TISSUE WEBS

BACKGROUND OF THE INVENTION

Consumers use paper wiping products, such as facial tissues and bath tissues, for a wide variety of applications. Facial tissues are not only used for nose care but, in addition to other uses, can also be used as a general wiping product. Consequently, there are many different types of tissue products currently commercially available.

In some applications, tissue products are treated with polysiloxane lotions in order to increase the softness of the facial tissue. Adding silicone compositions to a facial tissue can impart improved softness to the tissue while maintaining the tissue's strength and while reducing the amount of lint produced by the tissue during use.

In the papermaking industry, various manufacturing techniques have been specifically designed to produce paper products which consumers find appealing. Manufacturers have employed various methods to apply chemical additives, such as silicone compositions, to the surface of a tissue web. Currently, one method of applying chemicals to the surface of a tissue web is the Rotogravure printing process. A Rotogravure printing process utilizes printing rollers to transfer chemicals onto a substrate. Chemical emulsions that are applied to webs using the Rotogravure printing process typically require the addition of water, surfactants, and/or solvents in order for the emulsions to be printed onto the substrate. Such additions are not only costly but also increase drying time and add process complexity.

Another method of applying chemical additives to the surface of a tissue web is spray atomization. Spray atomization is the process of combining a chemical with a pressurized gas to form small droplets that are directed onto a substrate, such as paper. One problem posed with atomization processes is that manufacturers often find it difficult to control the amount of chemical that is applied to a paper ply. Thus, a frequent problem with spray atomization techniques is that a large amount of over-spray is generated, which undesirably builds upon machinery as well as the surfaces of equipment and products in the vicinity of the spray atomizer. Furthermore, over-spray wastes the chemical being applied, and comprises a generally inefficient method of applying additives to a tissue web. Additionally, lack of control over the spray atomization technique also affects the uniformity of application to the tissue web.

In view of the above, a need exists in the industry for improving the method for application of chemical additives to the surface of a paper web.

Further, besides the above-mentioned difficulties in applying chemical additives to the surface of a paper web, some additives, such as softening agents, can also have a tendency to impart hydrophobicity to the treated paper web. Although hydrophobicity can be desirable in some applications, in other applications, increased hydrophobicity can adversely affect the product. For instance, increased hydrophobicity in a bath tissue can prevent the bath tissue from being wetted in a sufficient amount of time and prevent disintegration and dispersing when disposed in a commode or toilet. Hence, in some applications, it is difficult to find a proper balance between softness and absorbency, both of which are desirable attributes for tissues, particularly bath tissues.

Thus, a need also exists for a process of applying hydrophobic compositions to tissues for providing benefits to the tissue without increasing the hydrophibicity of the tissue beyond desirable limits.

SUMMARY OF THE INVENTION

In general, the present invention is directed to an improved process for applying compositions to paper webs, such as tissue webs, paper towels and wipers. The present invention is also directed to improved paper products made from the process.

For example, in one embodiment, the present invention is directed to a process for applying an additive to a paper web, such as a tissue web, that includes the step of extruding a viscous composition onto the paper web. The viscous composition has a viscosity sufficient for the composition to form fibers as the composition is extruded onto the web. In general, any suitable extrusion device can be used to apply the composition to the web. In one embodiment, for instance, the composition is extruded through a melt blown die and attenuated prior to being applied to the web.

The composition can generally be any material that provides benefits to paper webs. For instance, the composition can be a topical preparation that improves the physical properties of the web, that provides the web with antibacterial properties, that provides the web with medicinal properties, or that provides any other type of wellness benefits to a user of the paper web. For instance, the composition can contain an anti-acne agent, an antimicrobial agent, an anti-fungal agent, an antiseptic, an antioxidant, a cosmetic astringent, a drug astringent, an aiological agent, an emollient, an external analgesic, a humectant, a moisturizing agent, a skin conditioning agent, a skin exfoliating agent, a sunscreen agent, and mixtures thereof. In one embodiment, the composition is a softener. The softener can be, for instance, a polysiloxane.

Of particular advantage, the process of the present invention is well-suited to applying relatively high viscous compositions to paper webs. For instance, the composition can have a viscosity of at least 1000 cps, particularly 2000 cps and more particularly can have a viscosity of at least 3000 cps. Since the process is capable of handling high viscosity compositions, various chemical additives can be added directly to a paper web without having to dilute the additive with, for instance, water or any other type of dilution agent to form a solution or emulsion.

In fact, in one embodiment, a thickener can be added to the composition in order to increase the viscosity. The thickener can be, for instance, a polyethylene oxide. It should be understood, however, that any suitable or conventional thickener can also be used.

The amount of the composition that is applied to the paper web depends on the particular application. For example, when applying a softener to a tissue web, the softener can be added in an amount from about 0.1% to about 10% by weight and particularly from about 0.1% to about 5% by weight, based upon the weight of the web. As described above, in one embodiment, the composition is extruded through a melt blown die onto the paper web. The melt blown die can have a plurality of nozzles at a die tip. The nozzles can be arranged in one or more rows along the die tip. The fibers exiting the nozzles can have a diameter of from generally about 5 microns to about 100 microns or greater.

The process of the present invention provides great control over the amount of composition applied to the web and the placement of the composition on the web. It is believed that products made according to the process of the present invention have various unique characteristics. For instance, in one embodiment, a product made according to the present invention includes a paper web containing cellulosic fibers. The viscous composition containing a chemical additive is applied to at least one side of the paper web. In accordance with the present invention, the composition is present on the paper web in the form of fibers, such as continuous filaments.

Various features and aspects of the present invention will be made apparent from the following detailed description.

BRIEF DESCRIPTION OF THE DRAWINGS

A full and enabling disclosure of this invention, is set forth in this specification. The following Figures illustrate the invention.

Figure 1:
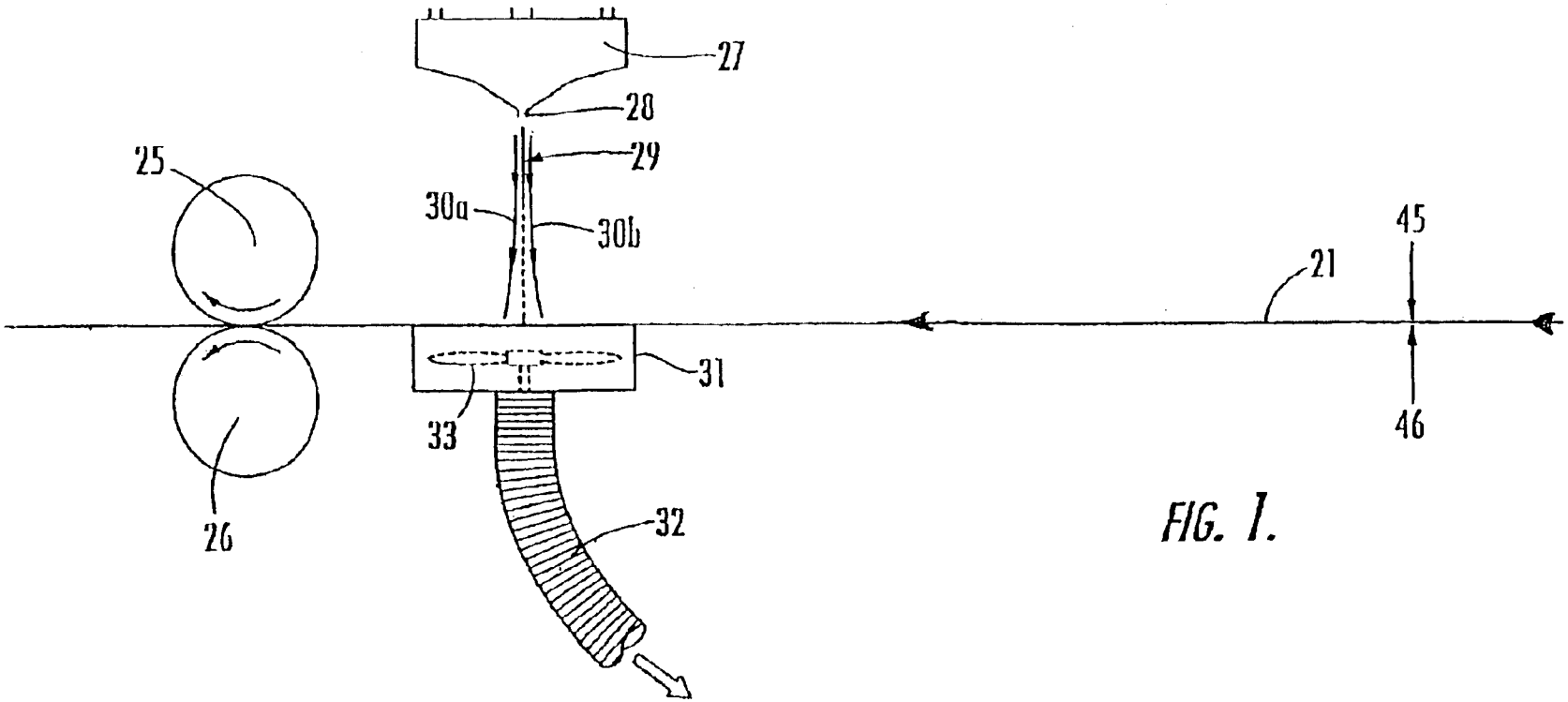
FIG. 1 is a schematic drawing showing application of a viscous composition through a melt blown die tip onto a paper web in accordance with the present invention.

Repeated use of reference characters in the present specification and drawings is intended to represent the same or analogous features of the invention.

DETAILED DESCRIPTION OF THE INVENTION

Reference now will be made to the embodiments of the invention, one or more examples of which are set forth below. Each example is provided by way of explanation of the invention, not as a limitation of the invention. In fact, it will be apparent to those skilled in the art that various modifications and variations can be made in the invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. It is to be understood by one of ordinary skill in the art that the present discussion is a description of exemplary embodiments only, and is not intended as limiting the broader aspects of the present invention, which broader aspects are embodied in the exemplary constructions.

In general, the present invention is directed to applying viscous chemical compositions through a melt blown die tip on to a paper web, such as a tissue web. It has been found by the present inventors that when compared with the Rotogravure printing process and the spray atomizing process, the melt blown process is more efficient.

For example, in comparison to the Rotogravure printing process, the process of the present invention for applying compositions to paper webs can be simpler and less complex. The process of the present invention also provides more flexibility with respect to operation parameters. For instance, it has been found that the process of the present invention provides better controls over flow rates and add on levels of the compositions being applied to the paper webs. In some applications, the process of the present invention may also allow the compositions to be applied to the paper webs at higher speeds in comparison to many Rotogravure printing processes.

In comparison to spray atomization processes, the process of the present invention can provide greater control over application rates and can apply compositions to paper webs more uniformly. The process of the present invention also can better prevent against over application of the composition and can provide better controls over placement of the composition onto the web.

Another advantage to the process of the present invention is that the process is well suited to applying relatively high viscous chemical additives to paper webs. Thus, it has been discovered that additives can be applied to paper webs without first combining the additives with dilution agents, solvents, surfactants, preservatives, antifoamers, and the like. As a result, the process of the present invention can be more economical and less complex than many conventional application systems.

In one embodiment, a composition containing a chemical additive in accordance with the present invention can be applied to a paper web in the form of fibers, such as, for instance, in the form or continuous fibers. Specifically, it has been discovered that under certain circumstances, compositions applied in accordance with the present invention will fiberize when extruded through the melt blown die tip. The ability to fiberize the compositions provides various advantages. For example, when formed into fibers, the composition is easily captured by the paper web. The fibers can also be placed on the web in specific locations. Further, when desired, the fibers will not penetrate through the entire thickness of the web, but instead, will remain on the surface of the web, where the chemical additives are intended to provide benefits to the consumer.

Another advantage of the present invention is that for some applications, a lesser amount of the chemical additive can be applied to the web than what was necessary in many rotogravure processes while still obtaining an equivalent or better result. In particular, it is believed that since the chemical additive can be applied in a relatively viscous form without having to be formed into an emulsion or a solution and because the chemical additive can be applied as fibers uniformly over the surface of a web, it is believed that the same or better results can be obtained without having to apply as much of the chemical additive as was utilized in many prior art processes. For example, a softener can be applied to a web in a lesser amount while still obtaining the same softening effect in comparison to Rotogravure processes and spray processes. Further, since less of the chemical additive is needed, additional cost savings are realized.

In one aspect of the present invention, a composition containing a hydrophobic chemical additive is applied to a tissue, such as a bath tissue. The chemical additive, can be, for instance, a softener. By applying the hydrophobic composition in a discontinuous manner, a tissue can be produced not only having a lotiony, soft feel, but also having good wettability, even with the addition of the hydrophobic composition. In this manner, viscous hydrophobic compositions can be applied to bath tissues for improving the properties of the tissue without adversely affecting the wettability of the tissue.

Possible ingredients or chemical additives that can be applied to paper webs in accordance with the present invention include, without limitation, anti-acne actives, antimicrobial actives, antifungal actives, antiseptic actives, antioxidants, cosmetic astringents, drug astringents, aiological additives, deodorants, emollients, external analgesics, film formers, fragrances, humectants, natural moisturizing agents and other skin moisturizing ingredients known in the art, opacifiers, skin conditioning agents, skin exfoliating agents, skin protectants, solvents, sunscreens, and surfactants. The above chemical additives can be applied alone or in combination with other additives in accordance with the present invention.

In one embodiment of the present invention, the process is directed to applying a softener to a tissue web. The softener can be, for instance, a polysiloxane that makes a tissue product feel softer to the skin of a user. Suitable polysiloxanes that can be used in the present invention include amine, aldehyde, carboxylic acid, hydroxyl, alkoxyl, polyether, polyethylene oxide, and polypropylene oxide derivatized silicones, such as aminopolydialkylsiloxanes. When using an aminopolydialkysiloxane, the two alkyl radicals can be methyl groups, ethyl groups, and/or a straight branched or cyclic carbon chain containing from about 3 to about 8 carbon atoms. Some commercially available examples of polysiloxanes include WETSOFT CTW, AF-21, AF-23 and EXP-2025G of Kelmar Industries, Y-14128, Y-14344, Y-14461 and FTS-226 of the Witco Corporation, and Dow Corning 8620, Dow corning 2-8182 and Dow Corning 2-8194 of the Dow Corning Corporation.

In the past, polysiloxanes were typically combined with water, preservatives, antifoamers, and surfactants, such as nonionic ethoxylated alcohols, to form stable and microbial-free emulsions and applied to tissue webs. Since the process of the present invention can accommodate higher viscosities, however, the polysiloxanes can be added directly to a tissue web or to another paper product without having to be combined with water, a surfactant or any other dilution agent. For example, a neat composition, such as a neat polysiloxane can be applied to a web in accordance with the present invention. Since the polysiloxane can be applied to a web without having to be combined with any other ingredients, the process of the present invention is more economical and less complex than many prior processes. Further, as described above, it has also been discovered that lesser amounts of the chemical additive can be applied to the web while still obtaining the same or better results, which provides further cost savings.

In the past, polysiloxanes and other additives were also used sparingly in some applications due to their hydrophobicity. For instance, problems have been experienced in applying polysiloxane softeners to bath tissues due to the adverse impact upon the wettability of the tissue. By applying the polysiloxanes as fibers at particular areas on the web, however, it has been discovered that hydrophobic compositions can be applied to tissue webs for improving the properties of the webs while maintaining acceptable wettability properties. In particular, as will be described in more detail below, in one embodiment of the present invention, a hydrophobic composition can be applied in a discrete or discontinuous manner to a paper web in order to maintain a proper balance between improving the properties of the web through the use of the composition and maintaining acceptable absorbency and wettability characteristics.

Referring to FIG. 1, one embodiment of a process in accordance with the present invention is illustrated. As shown, a tissue web 21 moves from the right to the left and is comprised of a first side 45 that faces upwards and a second side 46 that faces downward. The tissue web 21 receives a viscous composition stream 29 upon its first side 45.

In general, the composition stream 29 is applied to the web 21 after the web has been formed. The composition can be applied to the web, for instance, after the web has been formed and prior to being wound. Alternatively, the composition can be applied in a post treatment process in a rewinder system. As illustrated in FIG. 1, the web 21 can be calendared, using calendar rolls 25 and 26 subsequent to application of the composition. Alternatively, the web can be calendared and thereafter the composition can be applied to the web. The calendar rolls can provide a smooth surface for making the product feel softer to a consumer.

As shown in the figures, a composition containing a chemical additive is extruded to form a composition stream 29 that is directed onto the web 21. In general, any suitable extrusion device can be used in accordance with the present invention. In one embodiment, for instance, the extruder includes a melt blown die 27. A melt blown die is an extruder that includes a plurality of fine, usually circular, square or rectangular die capillaries or nozzles that can be used to form fibers. In one embodiment, a melt blown die can include converging high velocity gas (e.g. air) streams which can be used to attenuate the fibers exiting the nozzles. One example of a melt blown die is disclosed, for instance, in U.S. Pat. No. 3,849,241 to Butin, et al which is incorporated herein by reference.

As shown in FIG. 1, melt blown die 27 extrudes the viscous composition stream 29 from die tip 28. As illustrated, the melt down die can be placed in association with air curtain 30*a-b*. The air curtain 30*a-b* may completely surround the extruded composition stream 29, while in other applications the air curtain 30*a-b* may only partially surround the composition stream 29. When present, the air curtain can facilitate application of the composition to the paper web, can assist in forming fibers from the composition being extruded and/or can attenuate any fibers that are being formed. Depending upon the particular application, the air curtain can be at ambient temperature or can be heated.

An exhaust fan 31 is located generally below the tissue web 21. The exhaust fan 31 is provided to improve air flow and to employ a pneumatic force to pull the composition stream 29 down on to the first side 45 of the tissue web 21. The exhaust fan 31 serves to remove from the immediate vicinity airborne particles or other debris through an exhaust duct 32. The exhaust fan 31 operates by pulling air using the rotating propeller 33 shown in dotted phantom in FIG. 1.

Figure 2:
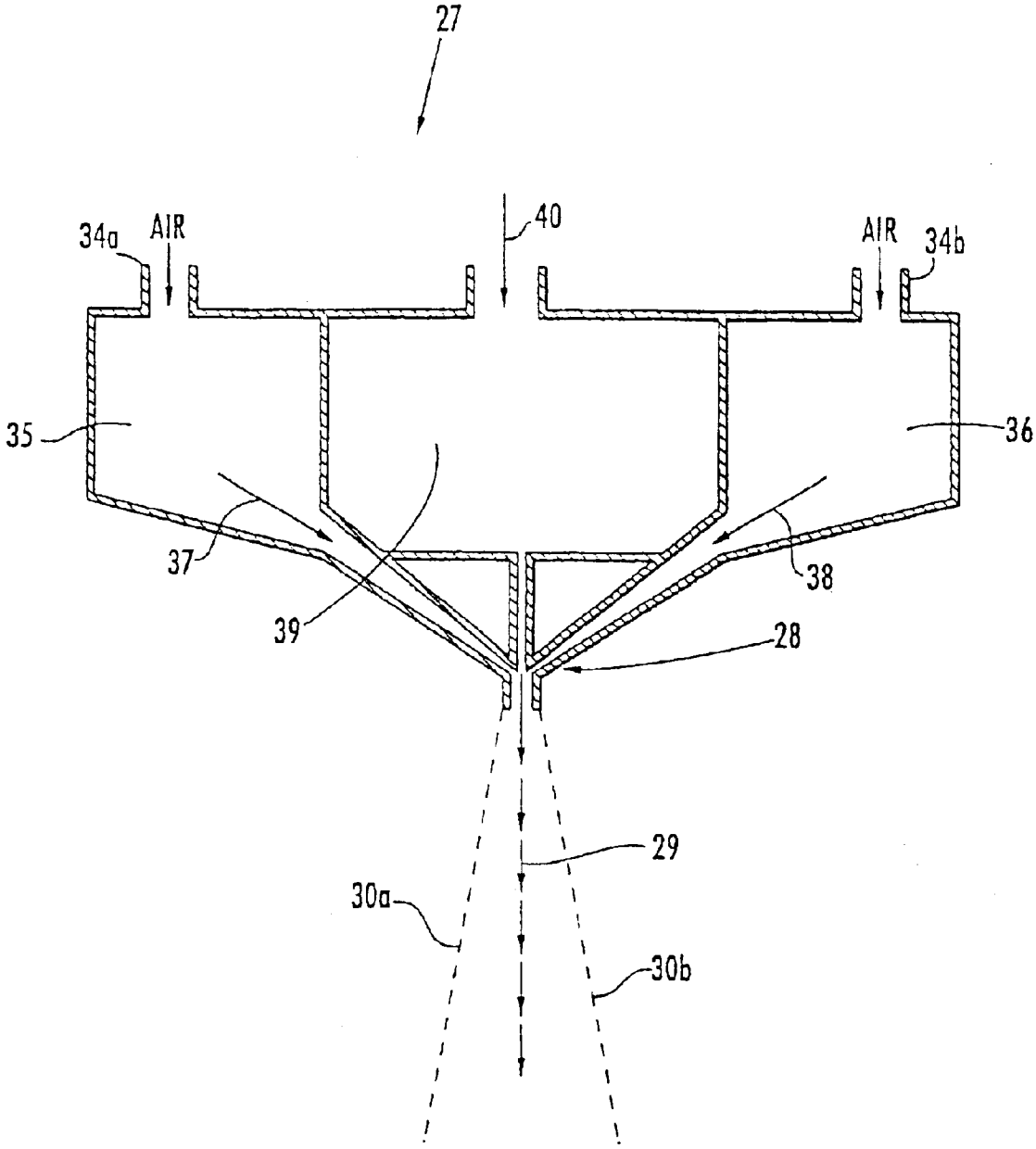
FIG. 2 is a side view of one embodiment of a melt blown die that can be used in accordance with the present invention.

In FIG. 2, a more detailed view of the melt blown die 27 is shown in which air intake 34*a-b* brings air into the melt blown die 27. Air travels into air duct 35 and air duct 36, respectively, from air intake 34*a* and 34*b*. The air proceeds along air pathway 37 and air pathway 38, respectively, to a point near the center of die tip 28 at which the air is combined with viscous composition 40 containing the desired chemical additives that emerges from a reservoir 39 to die tip 28. Then, the composition travels downward as viscous composition stream 29, shielded by air curtain 30*a-b*.

Figure 3:
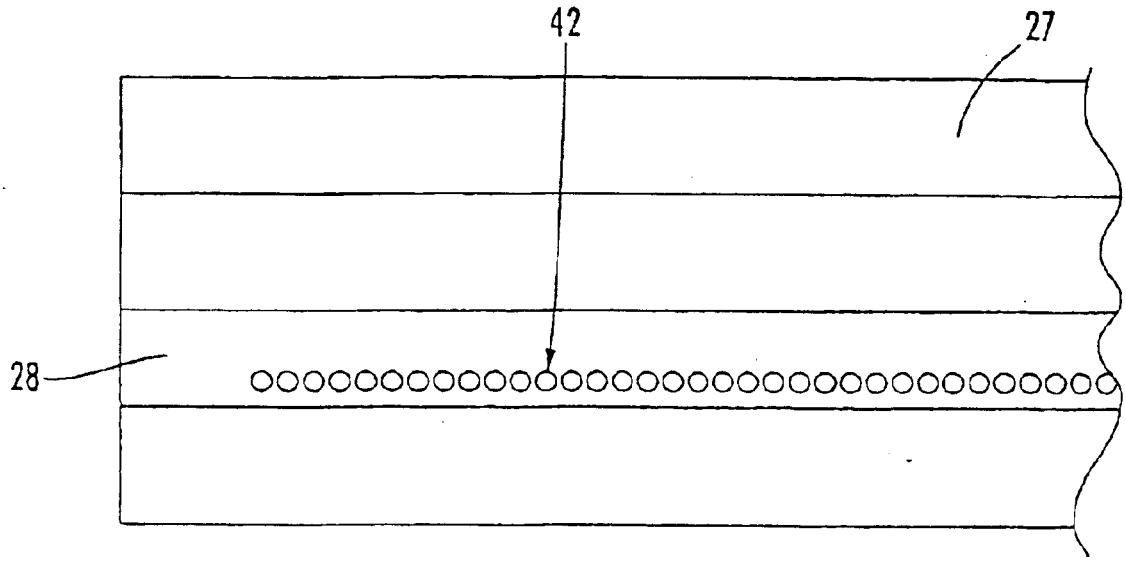
FIG. 3 is a bottom view of a portion of the melt blown die illustrated in FIG. 2 showing, in this embodiment, a row of nozzles through which compositions are extruded.

FIG. 3 shows a bottom view of the melt blown die 27 as it would appear looking upwards from the tissue web 21 (as shown in FIG. 1) along the path of the composition stream 29 to the point at which it emerges from die tip 28. In one embodiment, the melt blown die 27 is comprised of orifices 42 (several of which are shown in FIG. 3), and such orifices 42 may be provided in a single row as shown in FIG. 3. In other embodiments, there could be only a few scattered orifices 42; or perhaps, instead, a number of rows or even a series of channels could be used to release the composition stream 29 from melt blown die 27. In some cases, a combination of channels and orifices 42 could be used. In other cases (not shown), multiple rows of openings could be provided, and there is no limit to the different geometrical arrangement and patterns that could be provided to the melt blown die 27 for extruding a composition stream 29 within the scope of the invention.

In one specific embodiment of the invention, a pressurized tank (not shown) transfers a gas, such as air, to the melt blown die 27 for forcing the composition through the die tip. Composition 40 is forced through the melt blown die 27 and extruded through, for instance, holes or nozzles spaced along the length of the die tip. In general, the size of the nozzles and the amount of the nozzles located on the melt blown die tip can vary depending upon the particular application.

For example, the nozzles can have a diameter from about 10 mils to about 50 mils, and particularly from about 14 mils to about 25 mils. The nozzles can be spaced along the die tip in an amount from about 3 nozzles per inch to about 50 nozzles per inch, and particularly from about 5 nozzles per inch to about 30 nozzles per inch. For example, in one embodiment, a die tip can be used that has approximately 17 nozzles per inch, and wherein each nozzle has a diameter of about 14 mils.

Two streams of pressurized air converge on either side of the composition stream 29 after it exits the melt blown die 27. The resulting air pattern disrupts the laminar flow of the composition stream 29 and attenuates the fibers being formed as they are directed onto the surface of the web. Different sized orifices or nozzles will produce fibers having a different diameter.

In general, the fibers that can be formed according to the present invention include discontinuous fibers and continuous fibers. The fibers can have various diameters depending upon the particular application. For instance, the diameter of the fibers can vary from about 5 microns to about 100 microns. In one embodiment, continuous fibers are formed having a diameter of about 25 microns.

The flow rate of the composition 40 may be, for instance, from about 2 grams/inch to about 9 grams/inch in one embodiment. The flow rate will depend, however, on the composition and chemical additive being applied to the paper web, on the speed of the moving paper web, and on various other factors. In general, the total add on rate of the composition (including add on to both sides of the web if both sides are treated) can be up to about 10% based upon the weight of the paper web. When applying a softener to the paper web, for instance, the add on rate can be from about 0.1% to about 5% by weight, and particularly from about 0.5% to about 3% by weight of the paper web.

The viscosity of the composition can also vary depending upon the particular circumstances. When it is desired to produce fibers through the melt blown die, the viscosity of the composition should be relatively high. For instance, the viscosity of the composition can be at least 1000 cps, particularly greater than about 2000 cps, and more particularly greater than about 3000 cps. For example, the viscosity of the composition can be from about 1000 to about 50,000 cps and particularly from about 2000 to about 10,000 cps.

As stated above, the purpose for air pressure or air curtain 30*a-b* on either side of the composition stream 29 (in selected embodiments of the invention) is to assist in the formation of fibers, to attenuate the fibers, and to direct the fibers onto the tissue web. Various air pressures may be used.

The temperature of the composition as it is applied to a paper web in accordance with the present invention can vary depending upon the particular application. For instance, in some applications, the composition can be applied at ambient temperatures. In other applications, however, the composition can be heated prior to or during extrusion. The composition can be heated, for instance, in order to adjust the viscosity of the composition. The composition can be heated by a pre-heater prior to entering the melt blown die or, alternatively, can be heated within the melt blown die itself using, for instance, an electrical resistance heater.

In one embodiment, the composition containing the chemical additive can be a solid at ambient temperatures (from about 20° C. to about 23° C.). In this embodiment, the composition can be heated an amount sufficient to create a flowable liquid that can be extruded through the meltblown die. For example, the composition can be heated an amount sufficient to allow the composition to be extruded through the meltblown die and form fibers. Once formed, the fibers are then applied to a web in accordance with the present invention. The composition can resolidify upon cooling.

Examples of additives that may need to be heated prior to being deposited on a paper web include compositions containing behenyl alcohol. Other compositions that may need to be heated include compositions that contain a wax, that contain any type of polymer that is a solid at ambient temperatures, and/or that contain a silicone. One particular embodiment of a composition that may need to be heated in accordance with the present invention is the following:

| INGREDIENT | WEIGHT PERCENT |
|---|---|
| Mineral Oil | 25 |
| Acetylated Lanolin Alcohol (ACETULAN available from Amerchol) | 10 |
| Tridecyl Neopentoate | 10 |
| Cerasin Wax | 25 |
| DOW Corning 200 20 cSt | 30 |

The above composition is well suited for use as a lotion when applied to a cellulosic web.

The above compositions can be heated to a temperature, for instance, from about 75° C. to about 150° C.

In FIG. 1, the composition containing the chemical additive is applied to the top surface of a paper web. It should be understood, however, that the composition can be applied to both sides of the paper surface of the web yet be applied to contain various voids in the coverage for permitting the web to become wet when contacted with water. For example, in one embodiment, the hydrophobic composition is applied to the web as fibers that overlap across the surface of the web but yet leave areas on the web that remain untreated.

Figure 4:
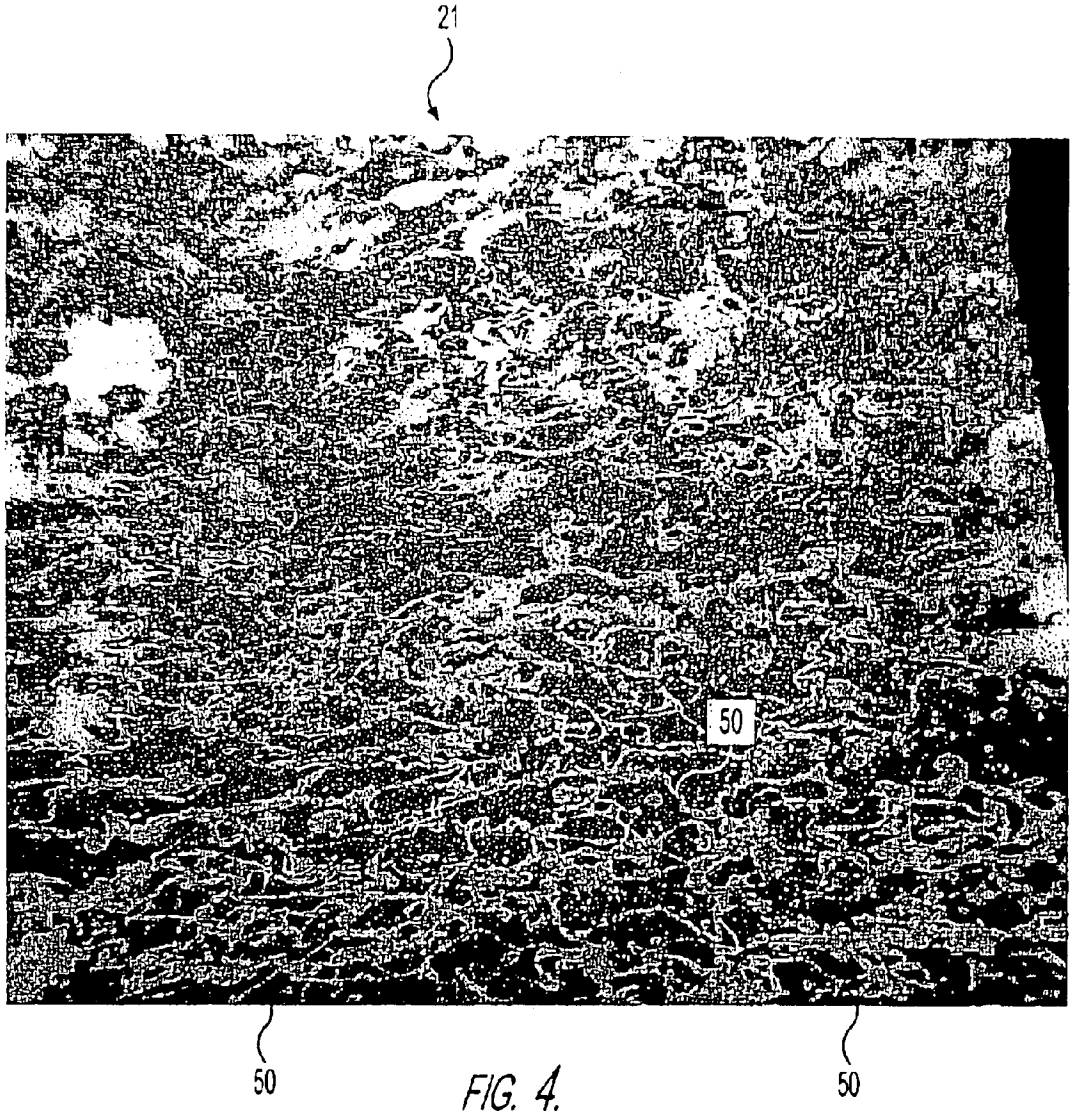
FIG. 4 is a plan view of one embodiment of a paper web made in accordance with the present invention.

Referring to FIG. 4, one embodiment of a paper web 21 treated in accordance with the present invention is shown. In this figure, the paper web is illustrated in a dark color to show the presence of fibers or filaments 50 appearing on the surface of the web. As shown, the filaments 50 intersect at various points and are randomly dispersed over the surface of the web. It is believed that the filaments 50 form a network on the surface of the web that increases the strength, particularly the wet strength of the web.

In the embodiment shown in FIG. 4, the filaments 50 only cover a portion of the surface area of the web 21. In this regard, the composition used to form the filaments can be applied to the web so as to cover from about 20% to about 80% of the surface of the web, and particularly from about 30% to about 60% of the surface area of the web. By leaving untreated areas on the web, the web remains easily wettable.

In this manner, extremely hydrophobic materials can be applied to the web for improving the properties of the web while still permitting the web to become wet in an acceptable amount of time when contacted with water.

In this manner, in one embodiment of the present invention, a hydrophobic softener can be applied to a bath tissue and still permit the bath tissue to disperse in water when disposed of. The softener, for instance, can be an aminopolydialkylsiloxane. In the past, when it has been attempted to apply softeners to bath tissue, typically a hydrophilically modified polysiloxane was used. The hydrophobic polysiloxanes, such as aminopolydialkylsiloxanes, however, not only have better softening properties, but are less expensive. Further, as described above, the process of the present invention allows lesser amounts of the additive to be applied to the tissue product while still obtaining the same or better results than many conventional processes.

One test that measures the wettability of a web is referred to as the "Wet Out Time" test. The Wet Out Time of paper webs treated in accordance with the present invention can be about 10 seconds or less, and more specifically about 8 seconds or less. For instance, paper webs treated in accordance with the present invention can have a Wet Out Time of about 6 seconds or less, still more specifically about 5 seconds or less, still more specifically from about 4 to about 6 seconds.

As used herein, "Wet Out time" is related to absorbency and is the time it takes for a given sample to completely wet out when placed in water. More specifically, the Wet Out Time is determined by cutting 20 sheets of the tissue sample into 2.5 inch squares. The number of sheets used in the test is independent of the number of plies per sheet of product. The 20 square sheets are stacked together and stapled at each corner to form a pad. The pad is held close to the surface of a constant temperature distilled water bath (23+/−2° C.), which is the appropriate size and depth to ensure the saturated specimen does not contact the bottom of the container and the top surface of the water at the same time, and dropped flat onto the water surface, staple points down. The time taken for the pad to become completely saturated, measured in seconds, is the Wet Out Time for the sample and represents the absorbent rate of the tissue. Increases in the Wet Out Time represent a decrease in the absorbent rate.

Any suitable tissue can be treated in accordance with the present invention. Further, a tissue product of the present invention can generally be formed by any of a variety of papermaking processes known in the art. In fact, any process capable of forming a paper web can be utilized in the present invention. For example, a papermaking process of the present invention can utilize adhesive creping, wet creping, double creping, embossing, wet-pressing, air pressing, through-air drying, creped through-air drying, uncreped through-drying, as well as other steps in forming the paper web. Some examples of such techniques are disclosed in U.S. Pat. No. 5,048,589 to Cook, et al.; U.S. Pat. No. 5,399,412 to Sudall, et al.; U.S. Pat. No. 5,129,988 to Farrington, Jr.; U.S. Pat. No. 5,494,554 to Edwards, et al.; which are incorporated herein in their entirety by reference for all purposes.

Besides tissue products, however, the process of the present invention can also be applied to paper towels and industrial wipers. Such products can have a basis weight of up to about 200 gsm and particularly up to about 150 gsm. Such products can be made from pulp fibers alone or in combination with other fibers, such as synthetic fibers.

In one embodiment, various additives can be added to the composition in order to adjust the viscosity of the composition. For instance, in one embodiment, a thickener can be applied to the composition in order to increase its viscosity. In general, any suitable thickener can be used in accordance with the present invention. For example, in one embodiment, polyethylene oxide can be combined with the composition to increase the viscosity. For example, polyethylene oxide can be combined with a polysiloxane softener to adjust the viscosity of the composition to ensure that the composition will produce fibers when extruded through the melt blown die.

EXAMPLE

In order to further illustrate the present invention, a conventional polysiloxane formulation was applied to a through-dried tissue web using a rotogravure coater. For purposes of comparison, a neat aminopolydimethylsiloxane was applied to the same bath tissue according to the present invention. In particular, the neat polydimethylsiloxane was fiberized using a uniform fiber depositor marketed by ITW Dynatec and applied in a discontinuous fashion to the tissue web.

More specifically, a single-ply, three-layered uncreped throughdried bath tissue was made using eucalyptus fibers for the outer layers and softwood fibers for the inner layer. Prior to pulping, a quaternary ammonium softening agent (C-6027 from Goldschmidt Corp.) was added at a dosage of 4.1 kg/Mton of active chemical per metric ton of fiber to the eucalyptus furnish. After allowing 20 minutes of mixing time, the slurry was dewatered using a belt press to approximately 32% consistency. The filtrate from the dewatering process was either sewered or used as pulper make-up water for subsequent fiber batches but not sent forward in the stock preparation or tissuemaking process. The thickened pulp containing the debonder was subsequently re-dispersed in water and used as the outer layer furnishes in the tissuemaking process.

The softwood fibers were pulped for 30 minutes at 4 percent consistency and diluted to 3.2 percent consistency after pulping, while the debonded eucalyptus fibers were diluted to 2 percent consistency. The overall layered sheet weight was split 30%/40%/30% among the eucalyptus/refined softwood/eucalyptus layers. The center layer was refined to levels required to achieve target strength values, while the outer layers provided the surface softness and bulk. Parez 631 NC was added to the center layer at 2–4 kilograms per tonne of pulp based on the center layer.

A three layer headbox was used to form the web with the refined northern softwood kraft stock in the two center layers of the headbox to produce a single center layer for the three-layered product described. Turbulence-generating inserts recessed about 3 inches (75 millimeters) from the slice and layer dividers extending about 1 inch (25.4 millimeters) beyond the slice were employed. The net slice opening was about 0.9 inch (23 millimeters) and water flows in all four headbox layers were comparable. The consistency of the stock fed to the headbox was about 0.09 weight percent.

The resulting three-layered sheet was formed on a twin-wire, suction form roll, former with forming fabrics being Lindsay 2164 and Asten 867a fabrics, respectively. The speed of the forming fabrics was 11.9 meters per second. The newly-formed web was then dewatered to a consistency of about 20–27 percent using vacuum suction from below the forming fabric before being transferred to the transfer fabric, which was traveling at 9.1 meters per second (30% rush transfer). The transfer fabric was an Appleton Wire T807-1. A vacuum shoe pulling about 6–15 inches (150–380 millimeters) of mercury vacuum was used to transfer the web to the transfer fabric.

The web was then transferred to a throughdrying fabric (Lindsay wire T1205-1). The throughdrying fabric was traveling at a speed of about 9.1 meters per second. The web was carried over a Honeycomb throughdryer operating at a temperature of about 350° F., (175° C.) and dried to final dryness of about 94–98 percent consistency. The resulting uncreped tissue sheet was then wound into a parent roll.

The parent roll was then unwound and the web was calendered twice. At the first station the web was calendered between a steel roll and a rubber covered roll having a 4 P&J hardness. The calendar loading was about 90 pounds per lineal inch (pli). At the second calendaring station, the web was calendered between a steel roll and a rubber covered roll having a 40 P&J hardness. The calender loading was about 140 pli. The thickness of the rubber covers was about 0.725 inch (1.84 centimeters).

A portion of the web was then fed into the rubber—rubber nip of a rotogravure coater to apply the polydimethylsiloxane emulsion to both sides of the web. The aqueous emulsion contained 25% polydimethylsiloxane; 8.3% surfactant; 0.75% antifoamer and 0.5% preservative.

The gravure rolls were electronically engraved, chrome over copper rolls supplied by Specialty Systems, Inc., Louisville, Ky. The rolls had a line screen of 200 cells per lineal inch and a volume of 6.0 Billion Cubic Microns (BCM) per square inch of roll surface. Typical cell dimensions for this roll were 140 microns in width and 33 microns in depth using a 130 degree engraving stylus. The rubber backing offset applicator rolls were a 75 shore A durometer cast polyurethane supplied by American Roller company, Union Grove, Wis. The process was set up to a condition having 0.375 inch interference between the gravure rolls and the rubber backing rolls and 0.003 inch clearance between the facing rubber backing rolls. The simultaneous offset/offset gravure printer was run at a speed of 2000 feet per minute using gravure roll speed adjustment (differential) to meter the polysiloxane emulsion to obtain the desired addition rate. The gravure roll speed differential used for this example was 1000 feet per minute. The process yielded an add-on level of 2.5 weight percent total add-on based on the weight of the tissue (1.25% each side).

Another portion or section of the formed tissue web was then fed through a uniform fiber depositor (a type of meltblown die) as described above. The uniform fiber depositor had 17 nozzles per inch and operated at an air pressure of 20 psi. The die applied a fiberized neat polysiloxane composition onto the web. The polysiloxane used in this example was obtained from Kelmar Industries. The polysiloxane was added to the web to yield an add-on level of 2.5 weight percent total add-on based on the weight of the tissue (1.25% each side).

After the two webs were formed, each web was tested for Wet Out Time and for geometric mean tensile strength (GMT). Geometric mean tensile strength is the square root of the product of the machine direction tensile strength and the cross-machine direction tensile strength of the web. Machine-direction and cross-machine direction tensile strengths were measure using an Instron tensile tester using a 3-inch jaw width, a jaw span of 4 inches and a process speed of 10 inches per minute. Prior to testing, the samples were maintained under TAPPI conditions (73° F., 50% relative humidity) for 4 hours. Tensile strength was reported in units of grams per inch.

The Wet Out Time was measured as described above. The following results were obtained:

| | WOT (Seconds) | GMT (Grams) |
|---|---|---|
| Sample 1 using gravure roll process | 5.2 | 732 |
| Sample 2 using uniform fiber depositor | 4.6 | 765 |

Besides the above test, the samples were also subjectively tested for softness and stiffness. It was determined from the test that although the softness of both samples were comparable, Sample Number 2 was less stiff.

It is understood by one of ordinary skill in the art that the present discussion is a description of exemplary embodiments only, and is not intended as limiting the broader aspects of the present invention, which broader aspects are embodied in the exemplary constructions. The invention is shown by example in the appended claims.

What is claimed:

1. A process for applying a hydrophobic additive to a tissue comprising the steps of:

providing a tissue web; and extruding a hydrophobic composition onto said tissue web, said composition being extruded through a melt blown die onto said web, said composition having a viscosity sufficient for said composition to form fibers as said composition is extruded through said melt blown die and onto said tissue web, said fibers being attenuated prior to being deposited onto the tissue web, said hydrophobic composition being applied to at least one side of the web, said hydrophobic composition being applied so as to cover from about 20% to about 80% of the surface area of the side of the web.

2. A process as defined in claim 1, wherein both sides of said web are treated with said hydrophobic composition.

3. A process as defined in claim 1, wherein said tissue web has a basis weight of less than about 60 gsm and wherein the treated tissue web has a Wet Out Time of less than about 5 seconds.

4. A process as defined in claim 3, wherein the tissue web has a basis weight of from about 25 gsm to about 45 gsm.

5. A process as defined in claim 1, wherein the hydrophobic composition consists essentially of a polysiloxane.

6. A process as defined in claim 1, wherein the treated tissue web has a Wet Out Time of no more than 3 seconds greater than the tissue web untreated.

7. A process as defined in claim 1, wherein the treated tissue web has a Wet Out Time of no more than 1 second greater than the tissue web untreated.

8. A process as defined in claim 1, wherein said viscous composition comprises a softener.

9. A process as defined in claim 8, wherein said softener comprises a polysiloxane.

10. A process as defined in claim 1, wherein said composition comprises a material selected from the group consisting of an anti-acne agent, an anti-microbial agent, an anti-fungal agent, an antiseptic, an antioxidant, a cosmetic astringent, a drug astringent, an aiological agent, an emollient, an external analgesic, a humectant, a moisturizing agent, a skin conditioning agent, a skin exfoliating agent, a sunscreen agent, and mixtures thereof.

11. A process as defined in claim 1, wherein said composition contains no surfactants.

12. A process as defined in claim 1, wherein said viscous composition has a viscosity of at least 1000 cps.

13. A process as defined in claim 1, wherein said viscous composition has a viscosity of at least 2000 cps.

14. A process as defined in claim 1, wherein said composition is heated prior to being extruded through said melt blown die.

15. A process as defined in claim 1, wherein said composition is applied to said tissue web in an amount of from about 0.1% to about 5% by weight of said web.

16. A process as defined in claim 1, wherein said composition forms continuous fibers as said composition is extruded through said melt blown die.

17. A process as defined in claim 1, wherein said fibers exiting said melt blown die have a diameter of from about 5 microns to about 100 microns.

18. A process as defined in claim 1, wherein the hydrophobic composition is applied so as to cover from about 30% to about 60% of the surface area of the side of the web.

19. A process as defined in claim 9, wherein the polysiloxane is an aminopolydialkylsiloxane.

20. A process as defined in claim 9, wherein the polysiloxane is an aminopolydimethylsiloxane.

21. A process as defined in claim 1, wherein the composition contains no preservatives.

22. A process as defined in claim 1, wherein the viscous composition has a viscosity of at least 3000 cps.

23. A process as defined in claim 1, wherein the composition is extruded ambient temperatures.

24. A process as defined in claim 1, wherein the composition is applied to the tissue web in an amount from about 0.5% to about 2% by weight of the web.

25. A tissue product comprising:

a tissue web comprising cellulosic fibers; and a topical viscous composition applied to at least one side of said tissue web, said viscous composition comprising a chemical additive, said viscous composition being present on said tissue web in the form of attenuated fibers, said viscous composition being applied to at least one side of the tissue web so as to cover from about 20% to about 80% of the surface area of the web.

26. A tissue product as defined in claim 25, wherein the tissue web has a basis weight of from about 25 gsm to about 45 gsm and a Wet Out Time of less than about 5 seconds.

27. A tissue product as defined in claim 25, wherein the topical composition is applied to bath sides of the web.

28. A tissue product as defined in claim 27, wherein the tissue web has a basis weight of from about 25 gsm to about 45 gsm and a Wet Out Time of less than about 4 seconds.

29. A tissue product as defined in claim 25, wherein the topical composition is applied to each side of the web in an amount so as to cover from about 30% to about 60% of the surface area of each side of the web.

30. A tissue product as defined in claim 29, wherein the tissue product has a Wet Out Time of less than about 5 seconds.

31. A tissue product as defined in claim 25, wherein the tissue product has a Wet Out Time of no more than 3 seconds greater than the tissue web untreated with the topical composition.

32. A tissue product as defined in claim 25, wherein the tissue product has a Wet Out Time of no more than 1 second greater than the tissue web untreated with the topical composition.

33. A tissue product as defined in claim 25, wherein said fibers comprise continuous filaments.

34. A tissue product as defined in claim 25, wherein said chemical additive comprises a softener.

35. A tissue product as defined in claim 25, wherein said viscous composition consists essentially a softener.

36. A tissue product as defined in claim 34, wherein said softener comprises a polysiloxane.

37. A tissue product as defined in claim 35, wherein said softener comprises a polysiloxane.

38. A tissue product as defined in claim 25, wherein said viscous composition is present on said tissue web in an amount from about 0.1% to about 5% by weight, based upon the weight of the web.

39. A tissue product as defined in claim 34, wherein the softener comprises an aminopolydialkylsiloxane.

40. A tissue product as defined in claim 35, wherein the softener is an aminopolydialkylsiloxane.

41. A tissue product comprising:

a tissue web having a basis weight of from about 25 gsm to about 45 gsm; and a hydrophobic composition applied to both sides of the tissue web, the hydrophobic composition comprising a chemical additive, the hydrophobic composition being present on the web in the form of attenuated fibers, the composition being applied to each side of the web so as to cover from about 20% to about 80% of the surface area of each side of the web, the treated tissue web having a Wet Out Time of less than about 5 seconds.

42. A tissue product as defined in claim 41, wherein the hydrophobic composition is applied to the web in an amount sufficient to cover from about 30% to about 60% of the surface area of both sides of the web.

43. A tissue product as defined in claim 41, wherein the product has a Wet Out Time of less than about 4.8 seconds.

44. A tissue product as defined in claim 41, wherein the tissue product comprising bath tissue.

45. A tissue product as defined in claim 41, wherein the hydrophobic composition comprises a polysiloxane.

46. A tissue product as defined in claim 41, wherein the hydrophobic composition consists essentially of a polysiloxane.

47. A tissue product as defined in claim 45, wherein the polysiloxane comprises an aminopolysiloxane or a polyether derivatised aminopolysiloxane.

48. A tissue product as defined in claim 41, wherein the fibers comprise continuous filaments.

49. A tissue product as defined in claim 41, the hydrophobic composition is present on the paper web in a total amount of from about 0.1% to about 5% by weight, based upon the weight of the web.

50. A tissue product as defined in claim 41, wherein the chemical additive is an aminopolydialkylsiloxane.

51. A process as defined in claim 1, wherein the hydrophobic composition comprises a lotion.

52. A tissue product as defined in claim 25, wherein the viscous composition comprises a lotion.

53. A tissue product as defined in claim 41, wherein the hydrophobic composition comprises a lotion.

* * * * *

UNITED STATES PATENT AND TRADEMARK OFFICE

CERTIFICATE OF CORRECTION

PATENT NO. : 6,805,965 B2
APPLICATION NO. : 10/036735
DATED : October 19, 2004
INVENTOR(S) : Kou-Chang Liu It is certified that error appears in the above-identified patent and that said Letters Patent is hereby corrected as shown below:

Column 13,
Lines 26 and 27, should read:
-- 23. A process as defined in claim 1, wherein the composition is extruded at ambient temperatures. --.
Lines 43 and 44, should read:
-- 27. A tissue product as defined in claim 25, wherein the topical composition is applied to both sides of the web. --.

Signed and Sealed this

Twentieth Day of June, 2006

JON W. DUDAS
*Director of the United States Patent and Trademark Office*